US010803797B2

(12) United States Patent
Liu et al.

(10) Patent No.: US 10,803,797 B2
(45) Date of Patent: Oct. 13, 2020

(54) DRIVING METHOD FOR DISPLAY PANEL, DRIVING CHIP AND DISPLAY DEVICE

(71) Applicant: WuHan TianMa Micro-Electronics Co., Ltd., Wuhan (CN)

(72) Inventors: Liyuan Liu, Wuhan (CN); Zhiyong Xiong, Wuhan (CN); Xia Li, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/444,047

(22) Filed: Jun. 18, 2019

(65) Prior Publication Data

US 2020/0135097 A1 Apr. 30, 2020

(30) Foreign Application Priority Data

Oct. 31, 2018 (CN) ..... 2018 1 1284027

(51) Int. Cl.
*G09G 3/3225* (2016.01)
*G09G 3/20* (2006.01)

(52) U.S. Cl.
CPC ..... *G09G 3/3225* (2013.01); *G09G 3/2007* (2013.01); *G09G 2320/0673* (2013.01); *G09G 2330/021* (2013.01); *G09G 2360/16* (2013.01)

(58) Field of Classification Search
CPC ..... G07F 17/322; G07F 17/3211; G07F 17/3223; G09G 3/20; G09G 3/2007; G09G 3/3208; G09G 3/32; G09G 3/3225; G09G 3/3233; G09G 3/3291; G09G 5/10; G09G 2300/043; G09G 2300/0819; G09G 2300/0866; G09G 2320/0233; G09G 2320/0276; G09G 2320/043; G09G 2320/0626; G09G 2320/0673;
(Continued)

(56) References Cited

U.S. PATENT DOCUMENTS 6,249,270 B1 * 6/2001 Ito ..... G09G 3/3696 345/100
2006/0038837 A1 * 2/2006 Hong ..... G09G 3/3648 345/691

(Continued)

FOREIGN PATENT DOCUMENTS

CN 104517568 A 4/2015
CN 106165007 A 11/2016

*Primary Examiner* — Michael J Eurice
(74) *Attorney, Agent, or Firm* — Tarolli, Sundheim, Covell & Tummino LLP

(57) ABSTRACT

A driving method for a display panel, a driving chip, and a display device are provided. The method includes: pre-storing Gamma curves corresponding to different display modes of the display panel; monitoring a display mode of the display panel when an image is displayed by the display panel, and acquiring a negative power voltage signal corresponding to the display mode; acquiring a Gamma curve corresponding to the display mode from the pre-stored Gamma curves based on the monitored display mode; outputting the negative power voltage signal to the display panel; and correcting the image displayed by the display panel according to the acquired Gamma curve. The above driving method is configured to drive the image displayed by the display panel.

13 Claims, 9 Drawing Sheets

(58) Field of Classification Search
CPC ..... G09G 2320/0295; G09G 2330/021; G09G 2360/16
See application file for complete search history.

(56) References Cited

U.S. PATENT DOCUMENTS

| | | | | |
|---|---|---|---|---|
| 2007/0080905 | A1* | 4/2007 | Takahara | G09G 3/3258 345/76 |
| 2007/0200803 | A1* | 8/2007 | Kimura | G09G 3/2022 345/76 |
| 2008/0150970 | A1* | 6/2008 | Ozawa | G09G 3/2014 345/690 |
| 2010/0311489 | A1* | 12/2010 | Miller | G07F 17/32 463/16 |
| 2012/0327066 | A1* | 12/2012 | Kato | G09G 3/3225 345/212 |
| 2014/0152721 | A1* | 6/2014 | Byun | G09G 3/3208 345/691 |
| 2015/0097872 | A1* | 4/2015 | Jeong | G09G 3/3225 345/690 |
| 2016/0071475 | A1* | 3/2016 | Su | G09G 3/3696 345/690 |
| 2017/0025061 | A1* | 1/2017 | Takizawa | G09G 3/3291 |
| 2017/0223233 | A1* | 8/2017 | Jung | G09G 3/006 |
| 2018/0122296 | A1* | 5/2018 | Lee | G09G 3/22 |
| 2019/0295490 | A1* | 9/2019 | Kim | G09G 3/20 |

* cited by examiner

S231 acquiring a linear equation y=kx+b corresponding to a mapping relationship between a grayscale and an actual negative power voltage signal according to a pre-stored mapping relationship between a grayscale and an actual negative power voltage signal S232 calculating a negative power voltage signal $V_{PVEE}$ corresponding to the plurality of display brightness values acquired according to $$V_{PVEE} = \sqrt[a]{\frac{L}{L_{max}}} \times 255 \times k + b$$

, wherein a is a Gamma value, L is an acquired display brightness value, and $L_{max}$ is a maximum display brightness value in the plurality of display brightness values corresponding to the plurality of display modes

FIG. 5

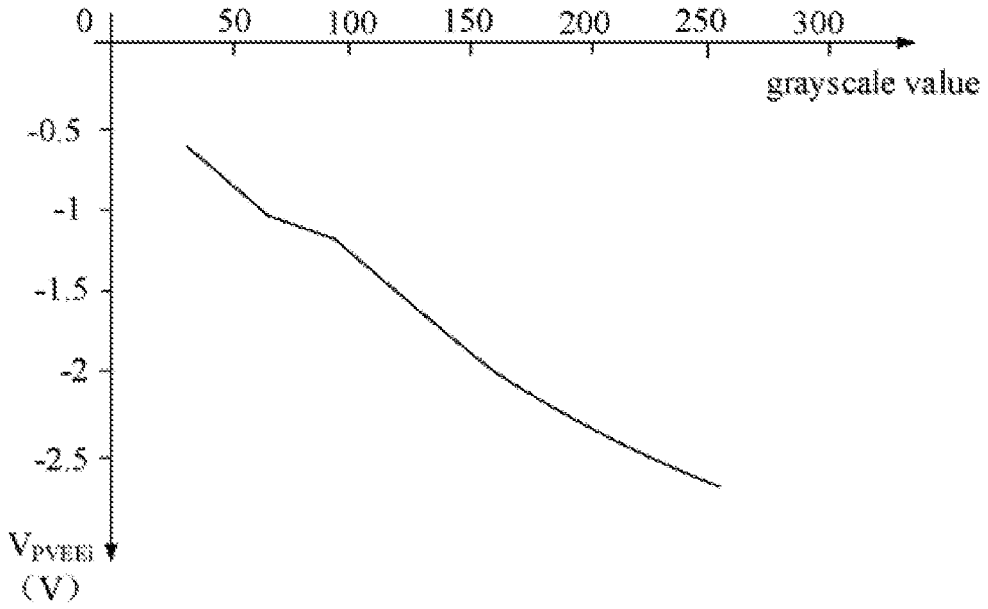

FIG. 6

DRIVING METHOD FOR DISPLAY PANEL, DRIVING CHIP AND DISPLAY DEVICE

CROSS-REFERENCE TO RELATED APPLICATIONS

The present application claims priority to Chinese Patent Application No. 201811284027.2, filed on Oct. 31, 2018, the content of which is incorporated herein by reference in its entirety.

TECHNICAL FIELD

The present disclosure relates to the field of display technologies, and in particular, to a driving method for a display panel, a driving chip, and a display device.

BACKGROUND

Current display panels typically include a variety of display modes such as indoor mode, outdoor mode, night-time mode, and daytime mode. The display panel displays with different brightness values in different display modes.

It can be understood that in order to drive the display panel for a normal operation, it is necessary to provide a positive power voltage signal and a negative power voltage signal for the display panel. In the existing display panels, the negative power voltage signal provided to the display panel is a negative power voltage signal corresponding to the maximum brightness that the display panel can display. However, in fact, when the display panel is in a display mode where the display brightness is low, it is not necessary to use such a strong negative power voltage signal, which causes redundancy of the negative power voltage signal, resulting in an increase in power consumption of the display panel.

SUMMARY

In view of this, the present disclosure provides a driving method for a display panel, a driving chip, and a display device, which not only can adjust the negative power voltage signal provided to the display panel so as to reduce power consumption of the display panel, but also cause the display panel present an image that is more in line with the perception of human eye in the current display mode so as to improve user's viewing experience.

In an aspect, the present provides a driving method for a display panel, and the driving method includes: pre-storing Gamma curves corresponding to different display modes of the display panel; monitoring a display mode of the display panel when an image is displayed by the display panel, and acquiring a negative power voltage signal corresponding to the display mode; acquiring a Gamma curve corresponding to the display mode from the pre-stored Gamma curves based on the monitored display mode; outputting the negative power voltage signal to the display panel; and correcting the image displayed by the display panel according to the acquired Gamma curve.

In another aspect, the present disclosure provides a driving chip, and the driving chip includes: a Gamma curve storage unit configured to pre-store Gamma curves corresponding to different display modes of a display panel; a monitoring unit configured to monitor a display mode of the display panel when an image is displayed by the display panel; a negative power voltage signal acquiring unit electrically connected to the monitoring unit and configured to acquire a negative power voltage signal corresponding to the monitored display mode; a Gamma curve acquiring unit electrically connected to the monitoring unit and the Gamma curve storage unit, respectively, and configured to acquire a Gamma curve corresponding to the display mode from the pre-stored Gamma curves based on the monitored display mode; an output unit electrically connected to the negative power voltage signal acquiring unit and configured to output the negative power voltage signal to the display panel; and a correcting unit electrically connected to the Gamma curve acquiring unit and configured to correct the image displayed by the display panel according to the acquired Gamma curve.

In still another aspect, the present disclosure provides a display device, and the display device includes a display panel and any of the driving chips disclosed in the present disclosure.

BRIEF DESCRIPTION OF DRAWINGS

In order to explain embodiments of the present disclosure, the drawings to be used in the description of the embodiments or the related art will be briefly described below. The drawings in the following description are some embodiments of the present disclosure. Those skilled in the art can acquire other drawings based on these drawings without paying any creative labor.

FIG. 5 is a flowchart of step S23 in a driving method according to an embodiment of the present disclosure;

FIG. 6 is a curve graph corresponding to a mapping relationship between a grayscale and an actual negative power voltage signal according to an embodiment of the present disclosure;

DETAILED DESCRIPTION

In order to better understand technical solutions of the present disclosure, the embodiments of the present disclosure are described in details with reference to the drawings.

It should be clear that the described embodiments are merely part of the embodiments of the present disclosure rather than all of the embodiments. All other embodiments acquired by those skilled in the art without paying creative labor shall fall into the protection scope of the present disclosure.

The terms used in the embodiments of the present disclosure are merely for the purpose of describing specific embodiment, rather than limiting the present disclosure. The terms "a", "an", "the" and "said" in a singular form in the embodiments of the present disclosure and the attached claims are also intended to include plural forms thereof, unless noted otherwise.

It should be understood that the term "and/or" used in the context of the present disclosure is to describe a correlation relation of related objects, indicating that there may be three relations, e.g., A and/or B may indicate only A, both A and B, and only B. In addition, the symbol "/" in the context generally indicates that the relation between the objects in front and at the back of "/" is an "or" relationship.

It should be understood that although the terms 'first' and 'second' may be used in the present disclosure to describe brightness acquiring sub-units, these brightness acquiring sub-units should not be limited to these terms. These terms are used only to distinguish the brightness acquiring sub-units from each other. For example, without departing from the scope of the embodiments of the present disclosure, a first brightness acquiring sub-unit may also be referred to as a second brightness acquiring sub-unit. Similarly, the second brightness acquiring sub-unit may also be referred to as the first brightness acquiring sub-unit.

Figure 1:
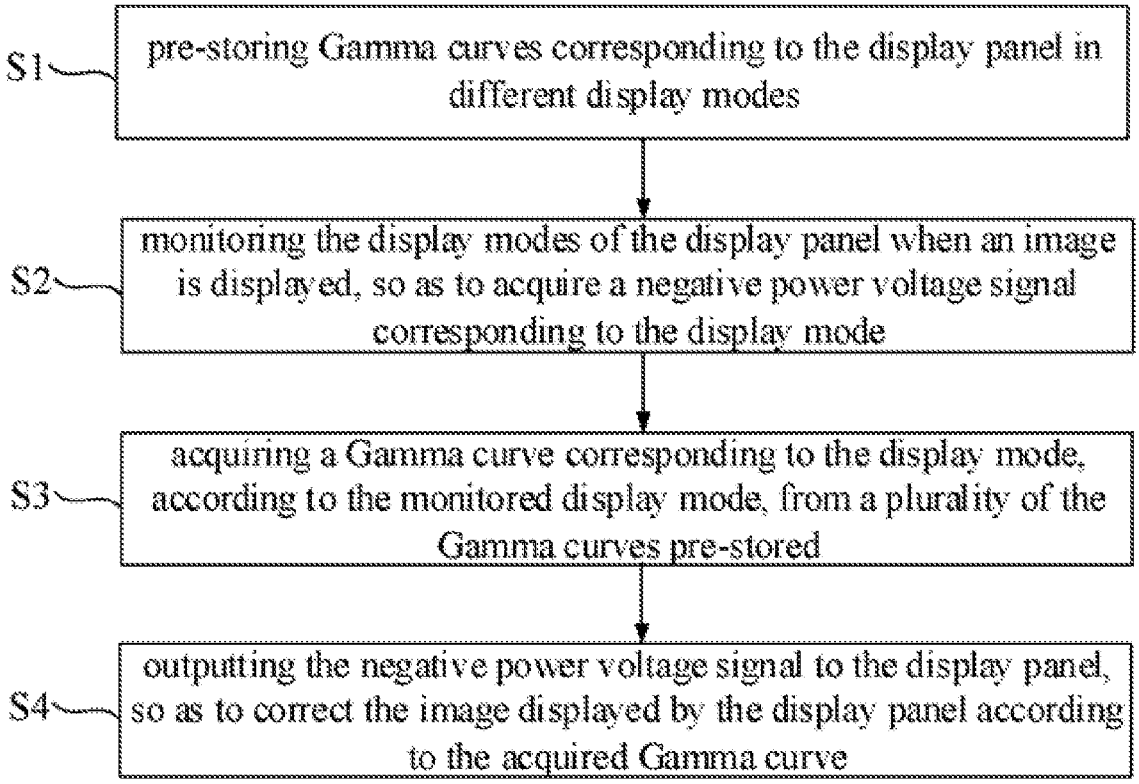
FIG. 1 is a flowchart of a driving method according to an embodiment of the present disclosure.

The present disclosure provides a driving method for a display panel. As shown in FIG. 1, FIG. 1 is a flowchart of a driving method according to an embodiment of the present disclosure. The driving method for a display panel includes the following steps.

Step S1: a Gamma curve corresponding to the display panel in different display modes is pre-stored.

For example, when the display mode of the display panel includes an outdoor mode, an indoor mode, a nighttime mode, and a daytime mode, Gamma curves respectively corresponding to the four display modes are pre-stored.

Step S2: the display mode of the display panel is monitored when an image is displayed, so as to acquire a negative power voltage signal corresponding to the display mode.

For example, when the display panel is in use, the current display mode of the display panel is monitored. If the display panel is currently in the nighttime mode, the negative power voltage signal corresponding to the nighttime mode is acquired.

Step S3: a Gamma curve corresponding to the display mode is acquired, according to the monitored display mode, from a plurality of the Gamma curves pre-stored.

For example, when it is monitored that the display panel is currently in the nighttime mode, the Gamma curve corresponding to the nighttime mode is retrieved from the four Gamma curves pre-stored.

Step S4: the negative power voltage signal is output to the display panel, so as to correct the image displayed by the display panel according to the acquired Gamma curve.

For example, when it is detected that the display panel is currently in the nighttime mode, the negative power voltage signal corresponding to the nighttime mode acquired in step S2 is output to the display panel, and the image displayed by the display panel is corrected according to the Gamma curve corresponding to the nighttime mode acquired in step S3, so that the display panel presents a corrected image more in line with perception of human eye.

With the driving method provided by the embodiments of the present disclosure, on the one hand, the current display mode of the display panel is monitored, and the negative power voltage signal provided to the display panel is adjusted. For example, the negative power voltage signal corresponding to the daytime mode is provided to the display panel when the display panel is in the daytime mode, and the negative power voltage signal corresponding to the nighttime mode is provided to the display panel when the display panel is in the nighttime mode. In this way, the negative power voltage signal provided to the display panel can be adaptively adjusted according to the current display mode, which will not cause redundancy of the negative power voltage signal, thereby reducing power consumption of the display panel. On the other hand, the display panel has different display brightness values in different display modes, so that the Gamma curves corresponding to different display modes are also different. The image displayed by the display panel is corrected by using the Gamma curve corresponding to the current display mode of the display panel, so that the corrected image is more in line with the perception of human eye under the brightness corresponding to the current display mode.

It can be seen that the driving method provided by the embodiments of the present disclosure not only can adaptively adjust the negative power voltage signal provided to the display panel to adapt the current display mode so as to reduce power consumption of the display panel, but also make the display panel present the image more in line with the perception of human eye in the current display mode so as to improve user's viewing experience.

Figure 2:
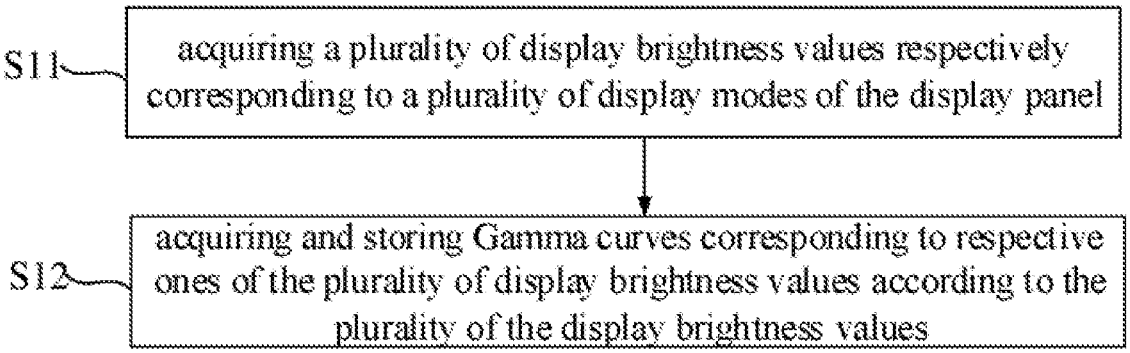
FIG. 2 is a flowchart of step S1 in a driving method according to an embodiment of the present disclosure.

Optionally, as shown in FIG. 2, FIG. 2 is a flowchart of step S1 in a driving method according to an embodiment of the present disclosure. Step S1 may include the following steps.

Step S11: a plurality of display brightness values respectively corresponding to a plurality of display modes of the display panel is acquired.

For example, the display brightness value corresponding to the indoor mode is 200 nits, the display brightness value corresponding to the outdoor mode is 350 nits, the display brightness value corresponding to the nighttime mode is 100 nits, and the display brightness value corresponding to the daytime mode is 430 nits.

Step S12: a Gamma curve corresponding to a respective one of the plurality of display brightness values is acquired and stored according to the plurality of the display brightness values.

Figure 3:
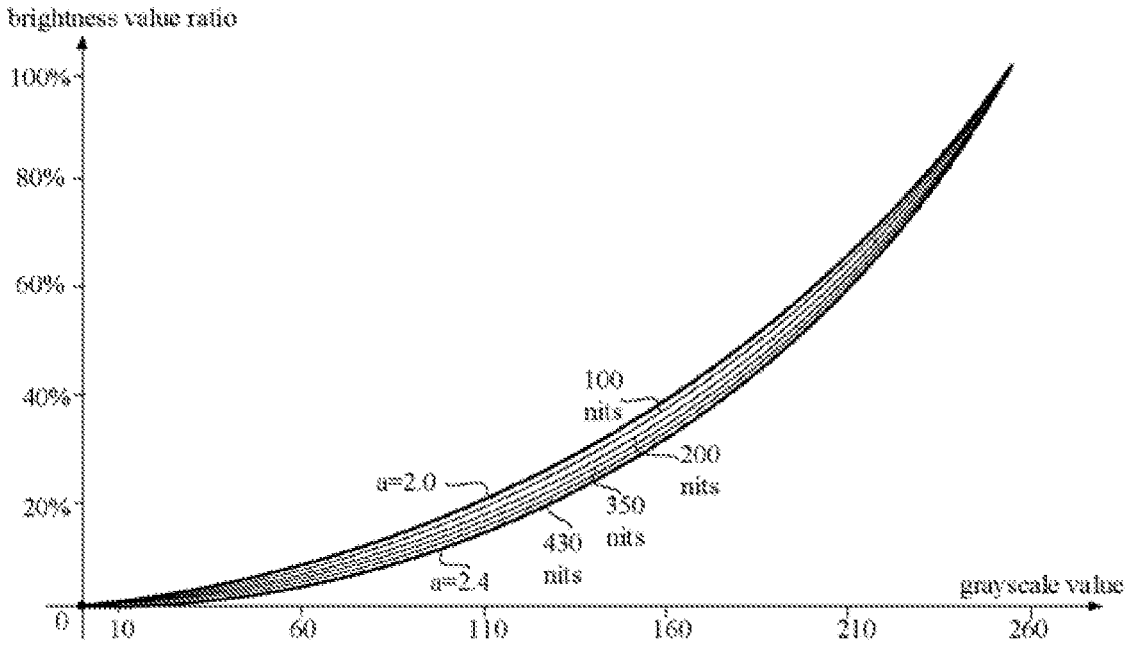
FIG. 3 is a curve graph illustrating Gamma curves corresponding to multiple display modes according to an embodiment of the present disclosure.

For example, the graph of the Gamma curves corresponding to the plurality of display modes is shown in FIG. 3. Here, the brightness value ratio shown in the longitudinal coordinate in FIG. 3 is a ratio of the brightness value/to the brightness value/$_{max}$ corresponding to the grayscale value 255.

It should be noted that when a Gamma value a corresponding to the Gamma curve is in a range of 2.2-2.5, the display panel is corrected by using the Gamma curve, so that the corrected image can be more in line with the perception of human eye. Referring to FIG. 3 again, a plurality of Gamma curves corresponding to various display brightness values of the display panel are all located between the Gamma curve corresponding to a=2.0 and the Gamma curve corresponding to a=2.4. Therefore, this indicates that the image presented by the display panel in line with to the perception of human eye can be ensured by using the Gamma curves corresponding to the display brightness values to correct the display panel.

Since the display brightness values of the display panel in different display modes are different and the different display brightness values corresponds to different Gamma curves, when the display panel is at another display brightness value, if only the Gamma curve corresponding to a certain display brightness value is used to correct the display panel, the corrected image does not meet the perception of the human eye under the current display brightness value yet. However, by pre-storing a plurality of Gamma curves corresponding to different display brightness values in the display panel, when the current display mode of the display panel is monitored, that is, when the current display brightness value is monitored, the Gamma curve corresponding to the current display brightness value can be retrieved from the plurality of the Gamma curves, and then the display panel is corrected by this Gamma curve, so that the image presented by the display panel is in line with the perception of the human eye under the current display brightness value, thereby improving the user's viewing experience.

Figure 4:
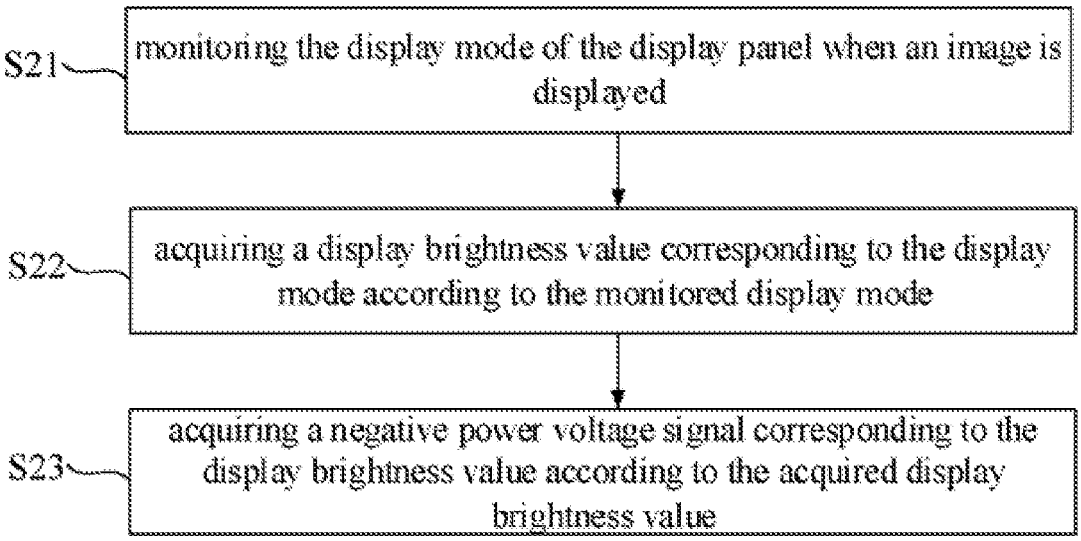
FIG. 4 is a flowchart of step S2 in a driving method according to an embodiment of the present disclosure.

Optionally, as shown in FIG. 4, FIG. 4 is a flowchart of step S2 in the driving method according to an embodiments of the present disclosure. Step S2 may include the following steps.

Step S21: the display mode of the display panel is monitored when the image is displayed.

Step S22: a display brightness value corresponding to the display mode is acquired according to the monitored display mode.

Step S23: a negative power voltage signal corresponding to the display brightness value is acquired according to the acquired display brightness value.

By monitoring the current display brightness value of the display panel to acquire a negative power voltage signal corresponding to the display brightness value, the negative power voltage signal corresponding to the current display brightness value can be provided to the display panel. Compared with the related art, in this way, during the use of the display panel, the negative power voltage signal can be adjusted in real time according to the current display brightness value, without causing redundancy of the negative power voltage signal, thereby reducing power consumption of the display panel.

Optionally, as shown in FIG. 5, FIG. 5 is a flowchart of step S23 in the driving method according to an embodiment of the present disclosure. Step S23 may include the following steps.

Step S231: a linear equation y=kx+b corresponding to a mapping relationship between a grayscale and an actual negative power voltage signal is acquired according to a pre-stored mapping relationship between a grayscale and an actual negative power voltage signal.

As shown in FIG. 6, FIG. 6 is a graph corresponding to a mapping relationship between a grayscale and an actual negative power voltage signal according to an embodiment of the present disclosure. The curve corresponding to the mapping relationship between the grayscale and the actual negative power voltage signal may be regarded as a linear curve, and the corresponding linear relationship is y=kx+b in which the coordinates of certain two points in the curve are substituted to acquire the values of k and b. For example, the shown curve corresponds to k=−0.0067, and b=−1.

Step S232: a negative power voltage signal $V_{PVEE}$ corresponding to the plurality of display brightness values acquired is calculated according to $$V_{PVEE} = \sqrt[a]{\frac{L}{L_{max}}} \times 255 \times k + b.$$

Here, a is a Gamma value, L is an acquired display brightness value, and $L_{max}$ is a maximum display brightness value in the plurality of display brightness values corresponding to the plurality of display modes.

For example, it is assumed that in the four display modes such as the outdoor mode, the indoor mode, the nighttime mode, and the daytime mode, the display panel emits light with a maximum display brightness in the daytime mode, that is, the maximum display brightness value $L_{max}$=430 nits. If the display panel is currently in nighttime mode, the current display brightness value is L=100 nits, that is, the negative power voltage signal corresponding to the nighttime mode is $$V_{PVEE} = \sqrt[a]{\frac{100}{430}} \times 255 \times (-0.0067) - 1.$$

By using this driving mode, the negative power voltage signal corresponding to the current display mode can be accurately acquired. The display panel can be driven in real time by using the negative power voltage signal corresponding to different display modes, which not only can ensure that the display state of the display panel accurately corresponds to the current display state, but also can reduce the power consumption of the display panel.

Optionally, a=2.0, or, a=2.2, or, a=2.4. When the Gamma value a corresponding to the Gamma curve is 2.0, 2.2 or 2.4, the Gamma curve under these Gamma values is used to correct the display panel, so that the corrected image can be more in line with perception of human eye.

Figure 7:
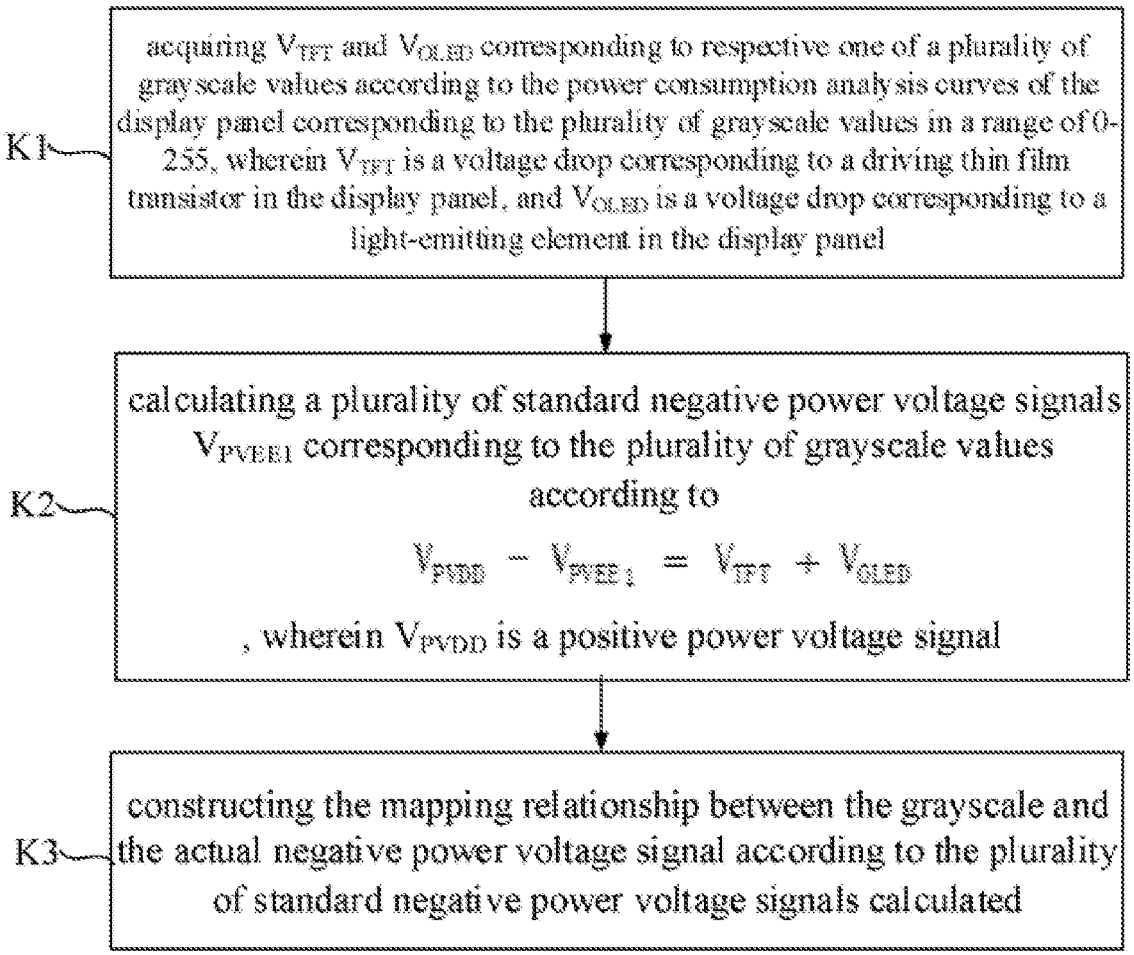
FIG. 7 is a flowchart of acquiring a mapping relationship between a grayscale and an actual negative power voltage signal according to an embodiment of the present disclosure.

Optionally, as shown in FIG. 7, FIG. 7 is a flowchart of acquiring a mapping relationship between a grayscale and an actual negative power voltage signal according to an embodiment of the present disclosure. Acquiring the mapping relationship between the grayscale and the actual negative power voltage signal includes:

Step K1: $V_{TFT}$ and $V_{OLED}$ corresponding to respective ones of a plurality of grayscale values are acquired according to the power consumption analysis curves of the display panel corresponding to the plurality of grayscale values in a range of 0-255. Here, $V_{TFT}$ is a voltage drop corresponding to a driving thin film transistor in the display panel, and $V_{OLED}$ is a voltage drop corresponding to a light-emitting element in the display panel.

Figure 8:
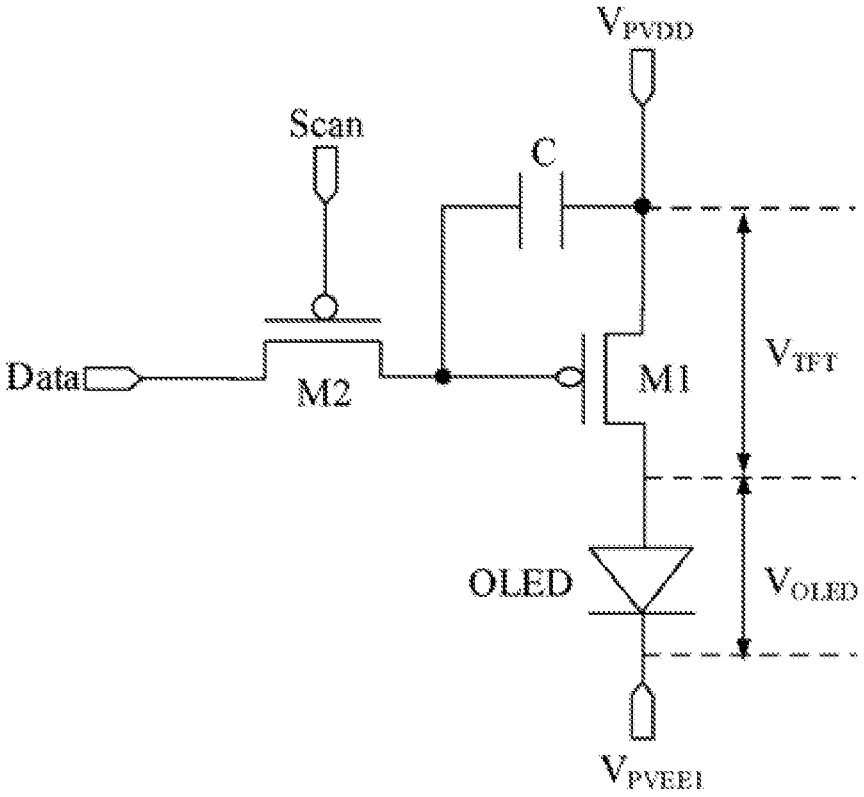
FIG. 8 is a schematic structural diagram of a conventional "2T1C" pixel driving circuit.

In one embodiment, taking the "2T1C" pixel driving circuit shown in FIG. 8 as an example, it can be understood that power consumption of the display panel is mainly determined by voltage drop between the positive power voltage signal and the negative power voltage signal. Moreover, this voltage drop consists of voltage drop $V_{TFT}$ of the driving thin film transistor M1 and voltage drop $V_{OLED}$ of the light-emitting element.

Figure 9:
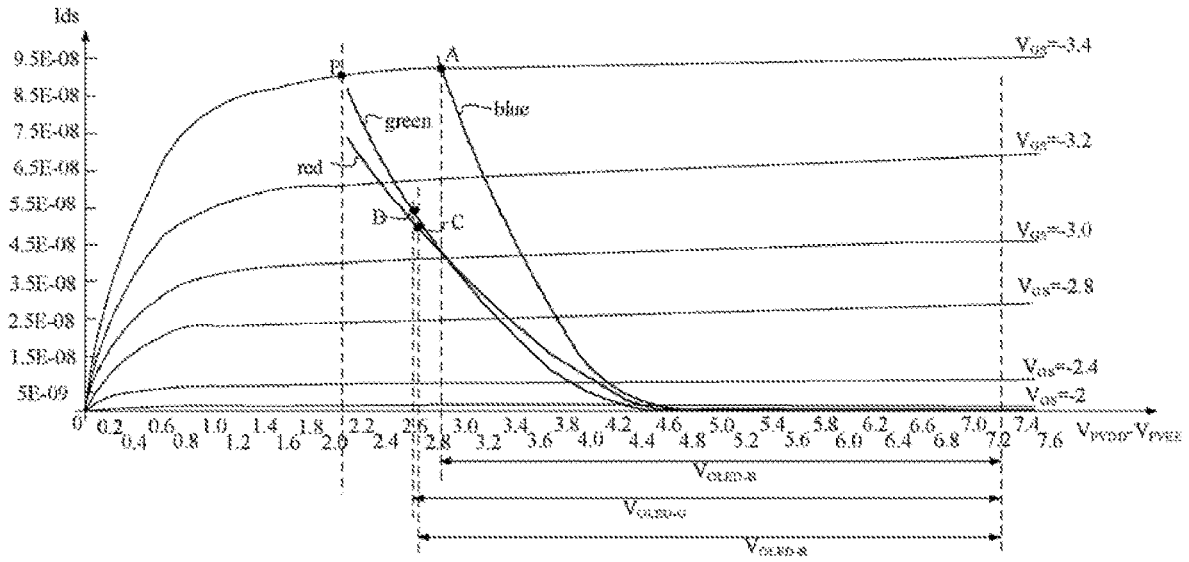
FIG. 9 is a curve graph showing a power consumption analysis curve of a display panel corresponding to 255 grayscale values according to an embodiment of the present disclosure.

Taking the grayscale value 255 and the display panel including a red sub-pixel, a green sub-pixel, and a blue sub-pixel as an example, in combination with FIG. 9, FIG. 9 is a graph showing a power consumption analysis curve of a display panel corresponding to 255 grayscale values according to an embodiment of the present disclosure. As shown in FIG. 9, it can be seen that the voltage value corresponding to an operating saturation point P of the driving thin film transistor is 2.1 V, that is, the voltage drop of the driving thin film transistor is $V_{TFT}$=2.1 V. Moreover, in FIG. 9, point A is the intersection of power consumption curve between the driving thin film transistor and the light-emitting element in the blue sub-pixel, and the voltage drop $V_{OLED-B}$ of the light-emitting element in the blue sub-pixel is 4.4 V according to the coordinates of point A; point B is the intersection of power consumption curve between the driving thin film transistor and the light-emitting element in the green sub-pixel, the voltage drop $V_{OLED-G}$ of the light-emitting element in the green sub-pixel is 4.65V according to the coordinates of point B; the point C is the intersection of power consumption curve between the driving thin film transistor and the light-emitting element in the red sub-pixel, the voltage drop $V_{OLED-R}$ of the light-emitting element in the red sub-pixel is 4.55V according to the coordinates of point C. Since the maximum value among $V_{OLED-B}$, $V_{OLED-G}$, and $V_{OLED-R}$ is required to be a baseline when a full white screen is synthesized in the display panel, the voltage drop $V_{TFT}$ of the driving thin film transistor corresponding to the grayscale value 255 is 2.1V, and the voltage drop $V_{OLED}$ of the light-emitting element is 4.65V.

Based on this method, the voltage drop $V_{TFT}$ of the driving thin film transistor and the voltage drop $V_{OLED}$ of the light-emitting element corresponding to the grayscale values 0-254 are respectively acquired by the power consumption analysis curves of the display panel corresponding to the grayscale values 0-254.

For example, the voltage drop $V_{TFT}$ of the driving thin film transistor and the voltage drop $V_{OLED}$ of the light-emitting element corresponding to partial grayscale values are shown in Table 1:

TABLE 1

| Grayscale value | $V_{OLED-R}$ (V) | $V_{OLED-G}$ (V) | $V_{OLED-B}$ (V) | $V_{TFT}$ (V) | $V_{PVEE1}$ (V) |
|---|---|---|---|---|---|
| G255 | 4.55 | 4.65 | 4.4 | 2.1 | −2.15 |
| G224 | 4.35 | 4.45 | 4.15 | 2.1 | −1.95 |
| G192 | 3.95 | 4.25 | 3.75 | 2.1 | −1.75 |
| G160 | 3.55 | 3.85 | 3.55 | 1.9 | −1.15 |
| G127 | 3.35 | 3.35 | 3.42 | 1.9 | −0.65 |
| G96 | 3.05 | 3.35 | 3.15 | 1.9 | −0.65 |
| G64 | 2.85 | 3.15 | 3.05 | 1.7 | −0.25 |
| G32 | 2.6 | 2.9 | 2.7 | 1.7 | −0 |

Step K2: a plurality of standard negative power voltage signal $V_{PVEE1}$ corresponding to the plurality of grayscale values is calculated according to $V_{PVDD}-V_{PVEE1}=V_{TFT}+V_{OLED}$. Here, $V_{PVDD}$ is a positive power voltage signal.

After the voltage drop $V_{TFT}$ of the driving thin film transistor and the voltage drop $V_{OLED}$ of the light-emitting element corresponding to the grayscale values 0-255 are respectively acquired, since the voltage value of the positive power voltage signal $V_{PVDD}$ is determined, the standard negative power voltage signals $V_{PVEE1}$ corresponding to the grayscale values 0-255 can be calculated according to $V_{PVDD}-V_{PVEE1}=V_{TFT}+V_{OLED}$. Referring to Table 1 again, the values of the standard negative power voltage signal $V_{PVEE1}$ corresponding to a part of the grayscale values are shown in Table 1.

Step K3: the mapping relationship between the grayscale and the actual negative power voltage signal is constructed according to the plurality of standard negative power voltage signals calculated.

Optionally, in the mapping relationship between the grayscale and the actual negative power voltage signal, the actual negative power voltage signals corresponding to the plurality of grayscale values are $V_{PVEE2}$, and $V_{PVEE}2=V_{PVEE1}$. That is, after the standard negative power voltage signal $V_{PVEE1}$ corresponding to the grayscale values 0-255 is respectively acquired, a mapping relationship between the grayscale and the actual negative power voltage signal is constructed based on the 256 standard negative power voltage signals $V_{PVEE1}$. At this time, the $V_{PVEEi}$ shown by the longitudinal coordinate in FIG. 6 is an actual negative power voltage signal $V_{PVEE2}$.

Optionally, in the mapping relationship between the grayscale and the actual negative power voltage signal, the actual negative power voltage signals corresponding to the plurality of grayscale values are $V_{PVEE2}'$, $V_{PVEE2}'=V_{PVEE1}-\Delta V$, and $\Delta V>0$. At this time, the $V_{PVEEi}$ shown by the longitudinal coordinate in FIG. 6 is an actual negative power voltage signal $V_{PVEE2'}$.

If the mapping relationship between the grayscale and the actual negative power voltage signal is constructed based on the standard negative power voltage signal $V_{PVEE1}$, the negative power voltage signal $V_{PVEE}$ based on the mapping relationship and acquired by $$V_{PVEE}=\sqrt[a]{\frac{L}{L_{max}}}\times 255\times k+b$$

is a truly required negative power voltage signal. However, after the negative power voltage signal $V_{PVEE}$ is provided to the display panel, the display panel is finally driven by a signal smaller than the negative power voltage signal $V_{PVEE}$ due to various factors such as device aging and transmission loss, that is, the signal actually driving the display panel is not the truly required negative power voltage signal. However, when the mapping relationship between the grayscale and the actual negative power voltage signal is constructed based on the actual negative power voltage signal $V_{PVEE2'}$, the negative power voltage signal $V_{PVEE}$ based on this mapping relationship and acquired by $$V_{PVEE}=\sqrt[a]{\frac{L}{L_{max}}}\times 255\times k+b$$

is a signal greater than the truly required negative power voltage signal. In this way, even if the negative power voltage signal $V_{PVEE}$ is attenuated during transmission, the display panel can be finally driven by the truly required negative power voltage signal, thereby improving accuracy of display state of the display panel.

Optionally, in order to further ensure that the display panel is finally driven by the truly required negative power voltage signal, $\Delta V$ may satisfy: $0.5V\leq\Delta V\leq 1.5$ V.

Figure 10:
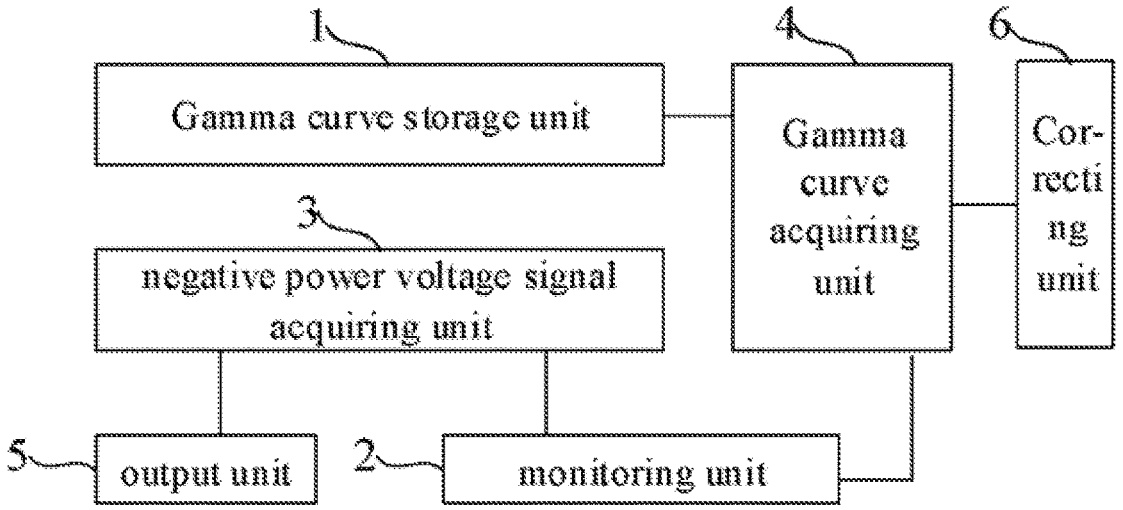
FIG. 10 is a schematic structural diagram of a driving chip according to an embodiment of the present disclosure.

The present disclosure further provides a driving chip. In conjunction with FIG. 1, as shown in FIG. 10, FIG. 10 is a schematic structural diagram of a driving chip according to an embodiment of the present disclosure. The driving chip includes a Gamma curve storage unit 1, a monitoring unit 2, a negative power voltage signal acquiring unit 3, a Gamma curve acquiring unit 4, an output unit 5, and a correcting unit 6.

The Gamma curve storage unit 1 is configured to pre-store a Gamma curve corresponding to the display panel in different display modes. The monitoring unit 2 is configured to monitor the display modes of the display panel when an image is displayed. The negative power voltage signal acquiring unit 3 is electrically connected to the monitoring unit 2 and configured to acquire a negative power voltage signal corresponding to the display mode according to the display mode monitored. The Gamma curve acquiring unit 4 is electrically connected to the monitoring unit 2 and the Gamma curve storage unit 1, respectively, and configured to acquire a Gamma curve corresponding to the display mode, according to the monitored display mode, in the plurality of the Gamma curves pre-stored. The output unit 5 is electrically connected to the negative power voltage signal acquiring unit 3 and configured to output the negative power voltage signal to the display panel. The correcting unit 6 is electrically connected to the Gamma curve acquiring unit 4 and configured to correct the image displayed by the display panel according to the acquired Gamma curve.

The driving method corresponding to the driving chip has been described in the above embodiment, which is not elaborated any more.

With the driving chip provided by the embodiments of the present disclosure, based on functions and connection relationships of structures in the driving chip, on the one hand, by monitoring the current display mode of the display panel and acquiring the negative power voltage signal corresponding to the current display mode, the negative power voltage signal provided to the display panel can be adaptively adjusted according to the current display mode, without causing redundancy of the negative power voltage signal, thereby reducing the power consumption of the display panel. On the other hand, the image displayed by the display panel is corrected by using the Gamma curve corresponding to the current display mode of the display panel, so that the display panel can present the image more in line with the perception of human eye in the current display mode, thereby improving user's viewing experience is improved.

Figure 11:
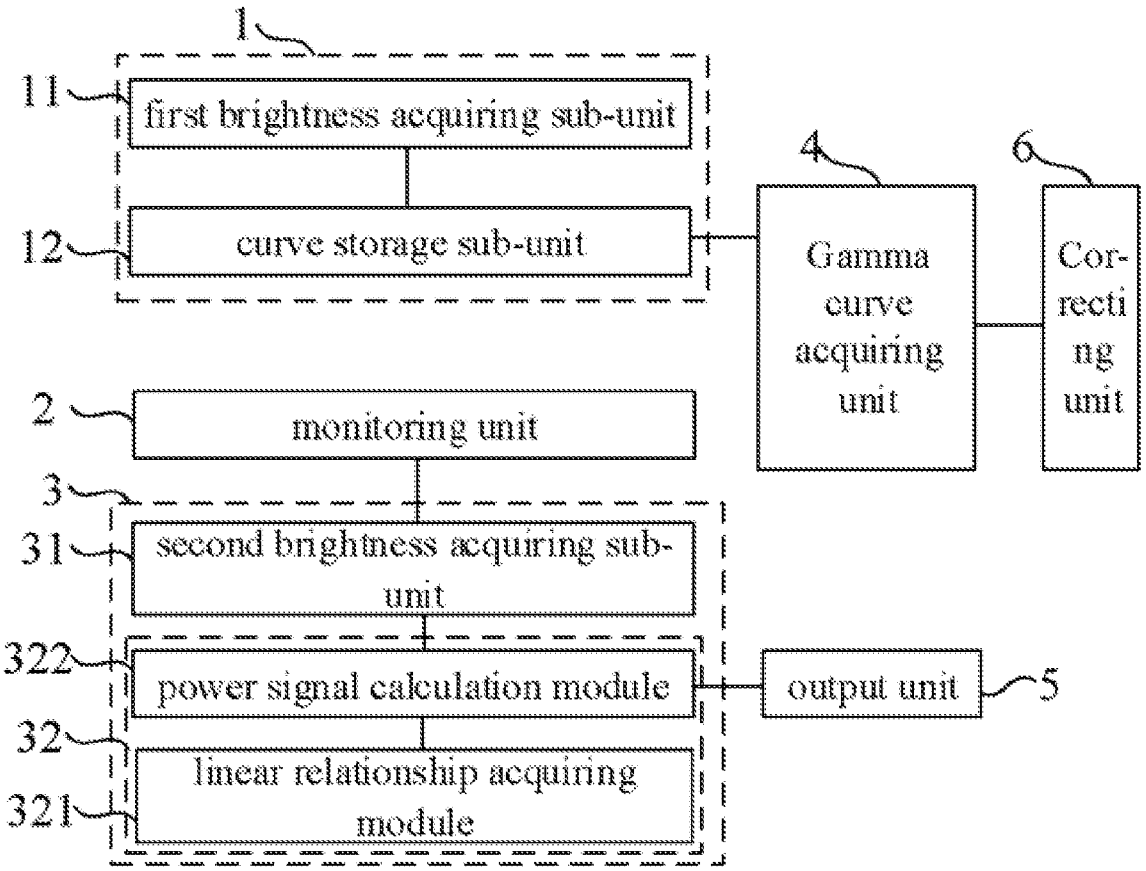
FIG. 11 is a schematic structural diagram of a driving chip according to another embodiment of the present disclosure.

Optionally, in conjunction with FIG. 2, as shown in FIG. 11, FIG. 11 is a schematic structural diagram of a driving chip according to another embodiment of the present disclosure. The Gamma curve storage unit 1 includes a first brightness acquiring sub-unit 11 and a curve storage sub-unit 12. The first brightness acquiring sub-unit 11 is configured to acquire a plurality of display brightness values corresponding to the plurality of display modes in the display panel. The curve storage sub-unit 12 is electrically connected to the first brightness acquiring sub-unit 11 and the Gamma curve acquiring unit 4, respectively, and configured to acquire and store the Gamma curve corresponding to the respective display brightness value according to the plurality of display brightness values.

By pre-storing a plurality of Gamma curves corresponding to different display brightness values in the curve storage sub-unit 12, when the current display brightness value of the display panel is monitored, the Gamma curve corresponding to the current display brightness value can be retrieved from the plurality of Gamma curves, and then the display panel is corrected by the Gamma curve, so that the image presented by the display panel is in line with the perception of the human eye under the current display brightness value, thereby improving the user's viewing experience.

Optionally, with reference to FIG. 4, referring to FIG. 11 again, the negative power voltage signal acquiring unit 3 includes a second brightness acquiring sub-unit 31 and a power signal acquiring sub-unit 32.

The second brightness acquiring sub-unit 31 is electrically connected to the monitoring unit 2 and configured to acquire a display brightness value corresponding to the display mode according to the monitored display mode. The power signal acquiring sub-unit 32 is electrically connected to the second brightness acquiring sub-unit 31 and the output unit 5, respectively, and configured to acquire a negative power voltage signal corresponding to the display brightness value according to the acquired display brightness value.

The negative power voltage signal corresponding to the current display brightness value is acquired by the second brightness acquiring sub-unit 31 and the power signal acquiring sub-unit 32. During use of the display panel, the output unit 5 is used to adjust the negative power voltage signal in real time, which will not cause redundancy of the negative power voltage signal, thereby reducing power consumption of the display panel.

Optionally, with reference to FIG. 5, referring to FIG. 11 again, the power signal acquiring sub-unit 32 includes a linear relationship acquiring module 321 and a power signal calculation module 322.

The linear relationship acquiring module 321 is configured to acquire a linear equation y=kx+b corresponding to the mapping relationship between the grayscale and the actual negative power voltage signal according to a pre-stored mapping relationship between a grayscale and an actual negative power voltage signal. The power signal calculation module 322 is electrically connected to the linear relationship acquiring module 321, the second brightness acquiring sub-unit 31, and the output unit 5, respectively, and configured to calculate a negative power voltage signal $V_{PVEE}$ corresponding to the acquired display brightness value according to $$V_{PVEE} = \sqrt[a]{\frac{L}{L_{max}}} \times 255 \times k + b.$$

Here, a is a Gamma value, L is an acquired display brightness value, and $L_{max}$ is a maximum display brightness value in the plurality of display brightness values corresponding to the plurality of display modes.

Based on functions and connection relationships of the linear relationship acquiring module 321 and the power signal calculation module 322, the negative power voltage signal corresponding to the current display mode can be accurately acquired, and the display panel can be driven in real time by using the negative power voltage signal corresponding to different display modes, which not only can ensure that the display state of the display panel accurately corresponds to the current display mode, but also can reduce power consumption of the display panel.

Figure 12:
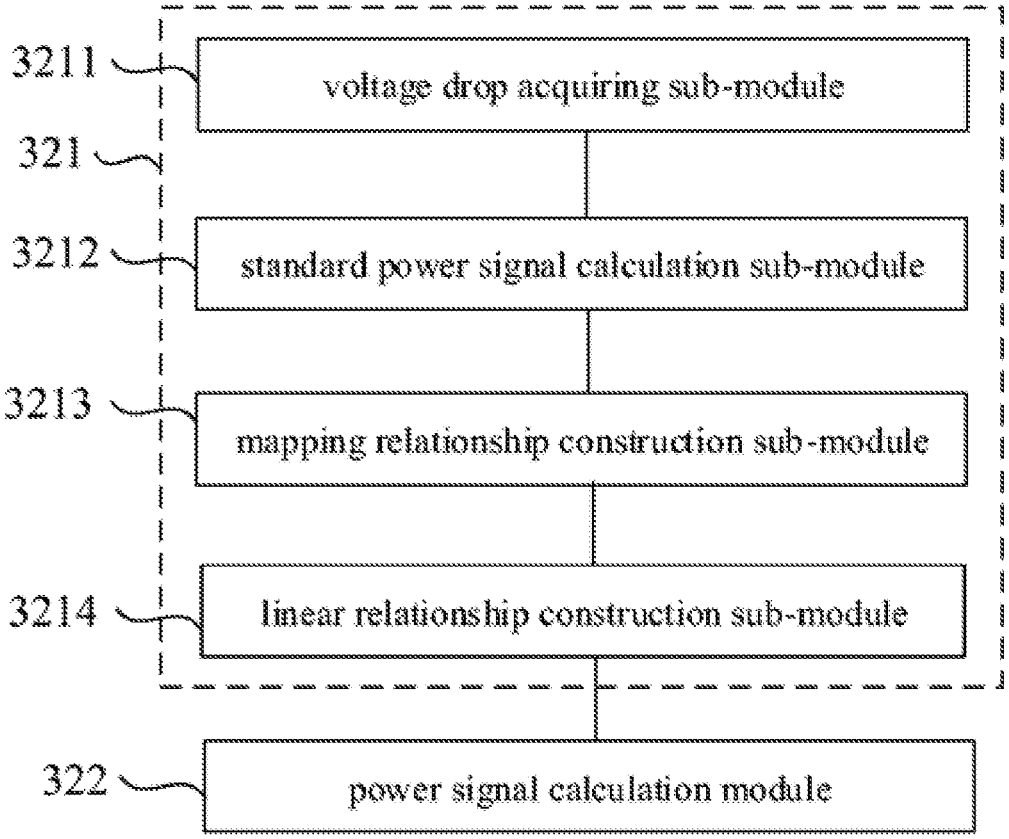
FIG. 12 is a schematic structural diagram of a linear relationship acquiring module according to an embodiment of the present disclosure.

Optionally, with reference to FIG. 7, as shown in FIG. 12, FIG. 12 is a schematic structural diagram of a linear relationship acquiring module according to an embodiment of the present disclosure. The linear relationship acquiring module 321 includes a voltage drop acquiring sub-module 3211, a standard power signal calculation sub-module 3212, a mapping relationship construction sub-module 3213, and a linear relationship construction sub-module 3214.

The voltage drop acquiring sub-module 3211 is configured to store the power consumption analysis curves of the display panel corresponding to the plurality of grayscale values ranging from 0 to 255, and acquire $V_{TFT}$ and $V_{OLED}$ corresponding to each of a plurality of grayscale values according to the power consumption analysis curves of the display panel. Here, $V_{TFT}$ is a voltage drop corresponding to a driving thin film transistor in the display panel, and $V_{OLED}$ is a voltage drop corresponding to a light-emitting element in the display panel.

The standard power signal calculation sub-module 3212 is electrically connected to the voltage drop acquiring sub-module 3211 and configured to calculate a plurality of standard negative power voltage signals $V_{PVEE1}$ corresponding to the plurality of grayscale values according to $V_{PVDD}-V_{PVEE_1}=V_{TFT}+V_{OLED}$, wherein $V_{PVDD}$ is a positive power voltage signal.

The mapping relationship construction sub-module 3213 is electrically connected to the standard power signal calculation sub-module 3212 and configured to construct the mapping relationship between the grayscale and the actual negative power voltage signal according to the plurality of standard negative power voltage signals calculated.

Optionally, when the mapping relationship between the grayscale and the actual negative power voltage signal is constructed by the mapping relationship construction sub-module 3213, the actual negative power voltage signal corresponding to the grayscale value is $V_{PVEE2}$, and $V_{PVEE2}=V_{PVEE1}$.

Optionally, when the mapping relationship between the grayscale and the actual negative power voltage signal is constructed by the mapping relationship construction sub-module 3213, the actual negative power voltage signal corresponding to the grayscale value is $V_{PVEE2'}$, $V_{PVEE2'}=V_{PVEE1}-\Delta V$, and $\Delta V>0$.

When the mapping relationship between the grayscale and the actual negative power voltage signal is constructed based on the actual negative power voltage signal $V_{PVEE2'}$, the negative power voltage signal $V_{PVEE}$ based on this mapping relationship and acquired by $$V_{PVEE}=\sqrt[a]{\frac{L}{L_{max}}}\times 255\times k+b$$

is a signal greater than a truly required negative power voltage signal. In this way, even if the negative power voltage signal $V_{PVEE}$ is attenuated during transmission, the display panel can be finally driven by the truly required negative power voltage signal, thereby improving accuracy of display state of the display panel.

The linear relationship construction sub-module 3214 is electrically connected to the mapping relationship construction sub-module 3213 and the power signal calculation module 322, respectively, and configured to acquire the corresponding linear equation y=kx+b according to the constructed mapping relationship between the grayscale and the actual negative power voltage signal.

Referring to FIG. 6 again, the curve corresponding to the mapping relationship between the grayscale and the actual negative power voltage signal can be regarded as a linear curve, and the corresponding linear relationship is y=kx+b in which the coordinates of certain two points in the curve are substituted to acquire the values of k and b.

It should be noted that when the relationship between the grayscale and the negative power voltage signal is constructed by the mapping relationship construction sub-module 3213 based on the actual negative power voltage signal $V_{PVEE2}$, the $V_{PVEEi}$ shown by the longitudinal coordinate in FIG. 6 is the actual negative power voltage signal $V_{PVEE2}$. When the relationship between the grayscale and the negative power voltage signal is constructed by the mapping relationship construction sub-module 3213 based on the actual negative power voltage signal $V_{PVEE2}'$, the $V_{PVEEi}$ shown by the longitudinal coordinate in FIG. 6 is the actual negative power voltage signal $V_{PVEE2}'$.

Figure 13:
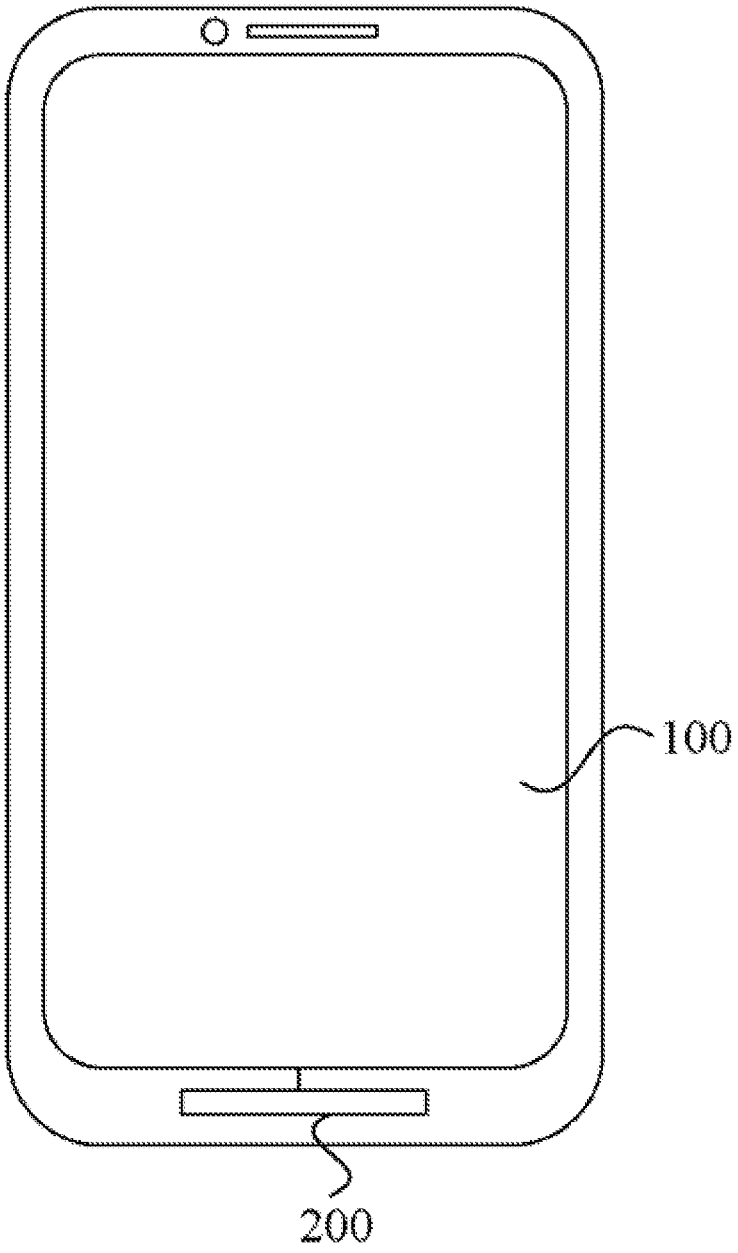
FIG. 13 is a schematic structural diagram of a display device according to an embodiment of the present disclosure.

The present disclosure further provides a display device. As shown in FIG. 13, FIG. 13 is a schematic structural diagram of a display device according to an embodiment of the present disclosure. The display device includes a display panel 100 and the above-mentioned driving chip 200. The structure of the driving chip 200 has been described in detail in the above embodiments, which is not elaborated any more. It is appreciated that, the display device shown in FIG. 13 is merely illustrative, and the display device may be any electronic device having a display function, such as a cellphone, a tablet computer, a laptop computer, an electronic paper book, or a television.

Since the display device provided by the embodiments of the present disclosure includes the above-mentioned driving chip 200, with the display device, the negative power voltage signal can be adaptively adjusted so as to adapt the current display mode, and reduce power consumption of the display device. Meanwhile, the image more in line with the perception of human eye in the current display mode can be presented by the display panel, thereby improving the user's viewing experience.

The above are merely preferred embodiments of the present disclosure, which, as mentioned above, are not used to limit the present disclosure. Whatever within the principles of the present disclosure, including any modification, equivalent substitution, improvement, etc., shall fall into the protection scope of the present disclosure.

What is claimed is:

1. A driving method for a display panel, comprising:

pre-storing Gamma curves corresponding to different display modes of the display panel;

monitoring a display mode of the display panel when the image is displayed, acquiring a display brightness value corresponding to the monitored display mode, acquiring a linear equation y=kx+b corresponding to pre-stored mapping relationships between grayscales and actual negative power voltage signals, and calculating a negative power voltage signal $V_{PVEE}$ corresponding to the acquired display brightness value according to $$V_{PVEE}=\sqrt[a]{\frac{L}{L_{max}}}\times 255\times k+b,$$

wherein a is a Gamma value, L is the acquired display brightness value, and $L_{max}$ is a maximum display brightness value among the display brightness values corresponding to the different display modes;

acquiring a Gamma curve corresponding to the display mode from the pre-stored Gamma curves based on the monitored display mode;

outputting the negative power voltage signal to the display panel; and correcting the image displayed by the display panel according to the acquired Gamma curve.

2. The driving method according to claim 1, wherein said pre-storing Gamma curves corresponding to different display modes of the display panel comprises:

acquiring display brightness values corresponding to the different display modes of the display panel; and acquiring and storing a Gamma curve corresponding to a respective one of the display brightness values according to the acquired display brightness values.

3. The driving method according to claim 1, wherein a=2.0, or a=2.2, or a=2.4.

4. The driving method according to claim 1, wherein the mapping relationships between the grayscales and the actual negative power voltage signals are acquired by:

acquiring $V_{TFT}$ and $V_{OLED}$ corresponding to a respective one of the grayscale values according to power consumption analysis curves of the display panel corresponding to the grayscale values in a range from 0 to 255, wherein $V_{TFT}$ is a voltage drop corresponding to a driving thin film transistor in the display panel, and $V_{OLED}$ is a voltage drop corresponding to a light-emitting element in the display panel;

calculating a standard negative power voltage signal $V_{PVEE1}$ corresponding to a respective one of the grayscale values according to $V_{PVDD}-V_{PVEE1}=V_{TFT}+V_{OLED}$, wherein $V_{PVDD}$ is a positive power voltage signal; and constructing the mapping relationships between the grayscales and the actual negative power voltage signals according to the calculated standard negative power voltage signals.

5. The driving method according to claim 4, wherein in the mapping relationships between the grayscales and the actual negative power voltage signals, the actual negative power voltage signals corresponding to the grayscale values are $V_{PVEE2}$, and $V_{PVEE2}=V_{PVEE1}$.

6. The driving method according to claim 4, wherein in the mapping relationships between the grayscales and the actual negative power voltage signals, the actual negative power voltage signals corresponding to the grayscale values are $V_{PVEE2'}$, $V_{PVEE2'}=V_{PVEE1}-\Delta V$, and $\Delta V>0$.

7. The driving method according to claim 6, wherein $0.5\ V\leq\Delta V\leq1.5\ V$.

8. A driving chip, comprising:

a Gamma curve storage unit configured to pre-store Gamma curves corresponding to different display modes of a display panel;

a monitoring unit configured to monitor a display mode of the display panel when an image is displayed by the display panel;

a negative power voltage signal acquiring unit comprising: a second brightness acquiring sub-unit electrically connected to the monitoring unit and configured to acquire a display brightness value corresponding to the monitored display mode; a linear relationship acquiring module configured to acquire a linear equation y=kx+b corresponding to the mapping relationships between grayscales and actual negative power voltage signals; and a power signal calculation module electrically connected to the linear relationship acquiring module, the second brightness acquiring sub-unit and the output unit, respectively, and configured to calculate a negative power voltage signal $V_{PVEE}$ corresponding to the acquired display brightness values according to $$V_{PVEE}=\sqrt[a]{\frac{L}{L_{max}}}\times255\times k+b,$$

wherein a is a Gamma value, L is the acquired display brightness value, and $L_{max}$ is a maximum display brightness value among the display brightness values corresponding to the different display modes;

a Gamma curve acquiring unit electrically connected to the monitoring unit and the Gamma curve storage unit, respectively, and configured to acquire a Gamma curve corresponding to the display mode from the pre-stored Gamma curves based on the monitored display mode;

an output unit electrically connected to the negative power voltage signal acquiring unit and configured to output the negative power voltage signal to the display panel; and a correcting unit electrically connected to the Gamma curve acquiring unit and configured to correct the image displayed by the display panel according to the acquired Gamma curve.

9. The driving chip according to claim 8, wherein the Gamma curve storage unit comprises:

a first brightness acquiring sub-unit configured to acquire display brightness values corresponding to the different display modes of the display panel; and a curve storage sub-unit electrically connected to the first brightness acquiring sub-unit and the Gamma curve acquiring unit, respectively, and configured to acquire and store a Gamma curve corresponding to a respective one of the acquired display brightness values.

10. The driving chip according to claim 8, wherein the linear relationship acquiring module comprises:

a voltage drop acquiring sub-module configured to store power consumption analysis curves of the display panel corresponding to the grayscale values in a range from 0 to 255, and acquire $V_{TFT}$ and $V_{OLED}$ corresponding to a respective one of the grayscale values according to the power consumption analysis curves of the display panel, wherein $V_{TFT}$ is a voltage drop corresponding to a driving thin film transistor in the display panel, and $V_{OLED}$ is a voltage drop corresponding to a light-emitting element in the display panel;

a standard power signal calculation sub-module electrically connected to the voltage drop acquiring sub-module and configured to calculate a standard negative power voltage signal $V_{PVEE1}$ corresponding to a respective one of the grayscale values according to $V_{PVDD}-V_{PVEE1}=V_{TFT}+V_{OLED}$, wherein $V_{PVDD}$ is a positive power voltage signal;

a mapping relationship construction sub-module electrically connected to the standard power signal calculation sub-module and configured to construct the mapping relationships between the grayscales and the actual negative power voltage signals according to the calculated standard negative power voltage signals; and a linear relationship construction sub-module electrically connected to the mapping relationship construction sub-module and the power signal calculation module, respectively, and configured to acquire the linear equation y=kx+b according to the constructed mapping relationships between the grayscales and the actual negative power voltage signals.

11. A display device, comprising:

a display panel, and a driving chip;

wherein the driving chip comprises:

a Gamma curve storage unit configured to pre-store Gamma curves corresponding to different display modes of a display panel;

a monitoring unit configured to monitor a display mode of the display panel when an image is displayed by the display panel;

a negative power voltage signal acquiring unit comprising: a second brightness acquiring sub-unit electrically connected to the monitoring unit and configured to acquire a display brightness value corresponding to the monitored display mode; a linear relationship acquiring module configured to acquire a linear equation y=kx+b corresponding to the mapping relationships between grayscales and actual negative power voltage signals; and a power signal calculation module electrically connected to the linear relationship acquiring module, the second brightness acquiring sub-unit and the output unit, respectively, and configured to calculate a negative power voltage signal VPVEE corresponding to the acquired display brightness values according to $$V_{PVEE} = \sqrt[a]{\frac{L}{L_{max}}} \times 255 \times k + b,$$

wherein a is a Gamma value, L is the acquired display brightness value, and $L_{max}$ is a maximum display brightness value among the display brightness values corresponding to the different display modes;

a Gamma curve acquiring unit electrically connected to the monitoring unit and the Gamma curve storage unit, respectively, and configured to acquire a Gamma curve corresponding to the display mode from the pre-stored Gamma curves based on the monitored display mode;

an output unit electrically connected to the negative power voltage signal acquiring unit and configured to output the negative power voltage signal to the display panel; and a correcting unit electrically connected to the Gamma curve acquiring unit and configured to correct the image displayed by the display panel according to the acquired Gamma curve.

12. The display device according to claim 11, wherein the Gamma curve storage unit comprises:

a first brightness acquiring sub-unit configured to acquire display brightness values corresponding to the different display modes of the display panel; and a curve storage sub-unit electrically connected to the first brightness acquiring sub-unit and the Gamma curve acquiring unit, respectively, and configured to acquire and store a Gamma curve corresponding to a respective one of the acquired display brightness values.

13. The display device according to claim 11, wherein the linear relationship acquiring module comprises:

a voltage drop acquiring sub-module configured to store power consumption analysis curves of the display panel corresponding to the grayscale values in a range from 0 to 255, and acquire $V_{TFT}$ and $V_{OLED}$ corresponding to a respective one of the grayscale values according to the power consumption analysis curves of the display panel, wherein $V_{TFT}$ is a voltage drop corresponding to a driving thin film transistor in the display panel, and $V_{OLED}$ is a voltage drop corresponding to a light-emitting element in the display panel;

a standard power signal calculation sub-module electrically connected to the voltage drop acquiring sub-module and configured to calculate a standard negative power voltage signal $V_{PVEE1}$ corresponding to a respective one of the grayscale values according to $V_{PVDD}-V_{PVEE1}=V_{TFT}+V_{OLED}$ , wherein VPVDD is a positive power voltage signal;

a mapping relationship construction sub-module electrically connected to the standard power signal calculation sub-module and configured to construct the mapping relationships between the grayscales and the actual negative power voltage signals according to the calculated standard negative power voltage signals; and a linear relationship construction sub-module electrically connected to the mapping relationship construction sub-module and the power signal calculation module, respectively, and configured to acquire the linear equation y=kx+b according to the constructed mapping relationships between the grayscales and the actual negative power voltage signals.

* * * * *